United States Patent [19]

Broersma

[11] Patent Number: 4,903,348

[45] Date of Patent: Feb. 27, 1990

[54] HELMET WITH STRAP HOLDER

[75] Inventor: Lester V. Broersma, Bellflower, Calif.

[73] Assignee: Bell Bicycles, Inc., Norwalk, Calif.

[21] Appl. No.: 248,616

[22] Filed: Sep. 26, 1988

[51] Int. Cl.[4] ..... A42B 7/00

[52] U.S. Cl. ..... 2/421; 2/425; 2/DIG. 6

[58] Field of Search ..... 2/183, 410, 411, 417, 2/418, 419, 420, 421, 425, DIG. 6

[56] References Cited

U.S. PATENT DOCUMENTS

| | | | |
|---|---|---|---|
| D. 272,769 | 2/1989 | Sundahl et al. | D2/231 |
| D. 272,770 | 2/1984 | Sundahl et al. | D2/232 |
| 935,556 | 9/1909 | Smith | 2/171.4 |
| 1,234,589 | 7/1917 | Wells | 2/181.6 |
| 1,347,046 | 7/1920 | McDonough | 2/410 |
| 2,769,176 | 11/1956 | Grancsay | 2/421 |
| 2,846,683 | 8/1958 | Dye et al. | 2/421 |
| 2,991,478 | 7/1961 | Zbikowski | 2/421 |
| 3,082,428 | 3/1963 | Zbikowski | 2/418 |
| 3,241,154 | 3/1966 | Aileo | 2/419 |
| 3,289,212 | 12/1966 | Morgan | 2/420 |
| 3,310,811 | 3/1967 | Iacono Jr. | 2/6 |
| 3,344,433 | 10/1967 | Stapenhill | 2/420 |
| 3,447,162 | 6/1969 | Aileo | 2/420 |
| 3,496,854 | 2/1970 | Feldmann et al. | 2/410 X |
| 3,783,450 | 1/1974 | O'Connor | 2/425 X |
| 3,873,997 | 4/1975 | Gooding | 2/421 X |
| 3,925,821 | 12/1975 | Lewicki | 2/425 |
| 4,044,400 | 8/1977 | Lewicki et al. | 2/421 |
| 4,075,714 | 2/1978 | Ryder et al. | 2/425 X |
| 4,110,847 | 9/1978 | Dera | 2/421 |
| 4,115,874 | 9/1978 | Hasegawa | 2/425 |
| 4,117,553 | 10/1978 | Bay | 2/10 |
| 4,305,160 | 12/1981 | Sundahl | 2/424 |
| 4,434,514 | 3/1984 | Sundahl et al. | 2/425 |
| 4,464,799 | 8/1984 | Nava | 2/421 |
| 4,555,816 | 12/1985 | Broersma | 2/425 |
| 4,612,675 | 9/1986 | Broersma | 2/425 X |
| 4,622,700 | 11/1986 | Sundahl | 2/425 |
| 4,627,115 | 12/1986 | Broersma | 2/425 |
| 4,653,123 | 3/1987 | Broersma | 2/425 |

FOREIGN PATENT DOCUMENTS

| | | | |
|---|---|---|---|
| 96148 | 12/1983 | European Pat. Off. | 2/411 |
| 280042 | 8/1988 | European Pat. Off. | 2/417 |
| 3112924 | 10/1982 | Fed. Rep. of Germany | 2/410 |
| 1452077 | 8/1966 | France | 2/420 |

*Primary Examiner*—Wm. Carter Reynolds
*Attorney, Agent, or Firm*—William W. Haefliger

[57] ABSTRACT

A helmet has a generally dome shaped helmet body with inner and outer sides, openings through the body to pass retention straps, a first strap holder configured to be supported at and by the outer side of the helmet, the holder attached to at least one strap that extends through one of the openings, and the holder operable to transmit strap tension to the helmet. The holder typically holds two strap ends, and defines slots through which the straps pass for adjustable retention by the holder.

21 Claims, 3 Drawing Sheets

HELMET WITH STRAP HOLDER

BACKGROUND OF THE INVENTION

This invention relates generally to helmet retention on a wearer's head, and more particularly to a retention system adjustable at helmet level or above.

Prior retention systems typically employing straps, or webs were characterized by multiple plastic or metal pieces or parts adjacent the wearer's face and used for retention adjustment. Such location of parts used for adjustment can be uncomfortable to the wearer, difficult to manipulate, and subject to entanglement. There is need for an improved retention system which obviates the use of such parts adjacent the face.

SUMMARY OF THE INVENTION

It is a major object of the invention to meet the above need through an improved adjustment means located at or above helmet level, and typically proximate the helmet upper outer surface. In accordance with the invention, the generally dome shaped helmet body has inner and outer sides, with openings through the body to pass retention straps; and in this environment a first strap holder is configured to be supported at and by the outer side of the helmet, the holder attached to at least one strap that extends through one of said openings, and the holder operable to transmit strap tension to the helmet.

Further, attachment means is typically provided to positively attach the holder to the helmet at said outer side thereof; also, the attachment means may very effectively comprise hook and pile elements one of which is carried by the holder and the other of which is carried by the helmet body; and the holder typically defines slot means through which the strap passes for adjustable retention by the holder proximate said one opening, for adjustment.

It is another object of the invention to provide the strap with a first portion extending back down into the one opening adjacent said first portion to terminate at or proximate said one opening.

It is yet another object to provide the holder in the form of a solid band received in a re-entrant recess at the top of the helmet; and, the band and recess may very advantageously have arc shape, cross-wise of the helmet outer side. The helmet may also define a notch proximate a side of the recess for finger reception to lift the holder from the recess, the holder being releasably retained in the recess; and attachment means may be provided to positively attach the holder to the helmet at its outer side, the helmet body typically consisting of expanded polystyrene.

It is a further object of the invention to provide a second strap holder configured to be supported at and by the outer side of the helmet, the holder attached to at least one strap that extends through one of the said openings, and the holder operable to transmit strap tension to the helmet. The holders typically consist of solid material and have adjustable connections to said straps, the holders releasably attached to the helmet body to be lifted for effecting strap adjustment, and to be re-attached to the body. Also, the holders may be integrated.

An additional object is to provide a fabric cover fitting over the body and holder and retained to the body proximate the lower edge thereof.

These and other objects and advantages of the invention, as well as the details of an illustrative embodiment, will be more fully understood from the following specification and drawings, in which:

DRAWING DESCRIPTION

DETAILED DESCRIPTION

Figure 1:
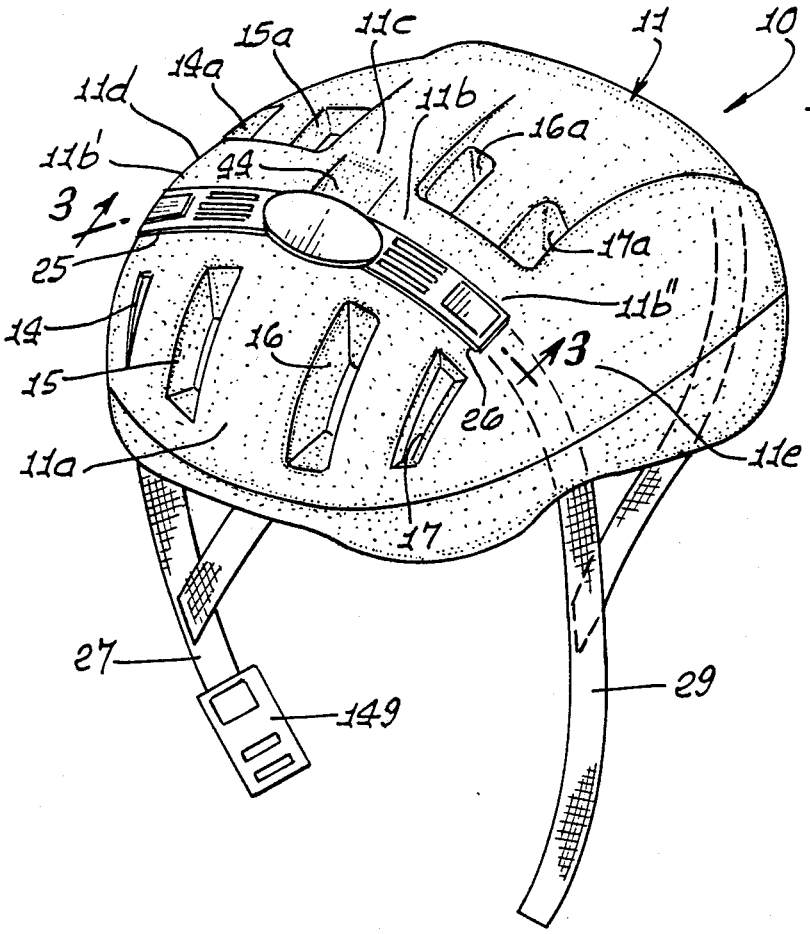
FIG. 1 is a frontal perspective view showing a helmet incorporating the invention.

In the drawings, the bicycle helmet 10 includes a generally dome shaped foamed plastic body 11 having inner and outer surfaces or sides 12 and 13. Body 11 may consist of air expanded polyestyrene. The body front 11*a* contains or defines four generally vertical openings 14–17 which are laterally spaced apart. Four rearward continuations 14*a*–17*a* of those openings are defined by an upper portion 11*c* of the body, forward of an upright plane that extend laterally and bisects the helmet into forward and rearward portions. Body portion 11*b* between the body portions 11*a* and 11*c* is uninterrupted by the air inlet openings, and extends laterally between regions 11*d* and 11*e*. The body rear extent 11*f* contains or defines four generally vertical openings 18–21 which are laterally spaced apart. Openings 15 and 16 extend through the shell-like body to constitute air inlet openings; and likewise, openings 19 and 20 extend through the body to constitute air discharge openings. Air flow passage 22 formed or sunk in the interior surface 12 guides or passes ventilation air from opening 15 to opening 19; and passage 23 also formed or sunk in surface 12 guides or passes air from opening 16 to opening 20. Openings 14, 17, 18, 21, and 14*a*–17*a* may constitute recesses, simulating air passing openings. Openings 14*a*–17*a* typically extend through the body, i.e. to intersect inner side 12.

In accordance with the invention, a first strap holder, as at 25, is configured to be supported at and by the outer side of the helmet, as for example body portion 11*b*'; and likewise, a second strap holder, as at 26, is configured to be supported at and by the outer side of the helmet, as for example at body portion 11*b*''. The body 11*b* includes portion 11*b*' at the right front, and portion 11*b*'' at the left front, i.e. at opposite sides of a vertical plane 100 that extends front to rear and bisects the helmet. Holders 25 and 26 may be integral with one another to define a single holder which is arc-shaped as is clear from FIG. 3; or they may be separate from one another, i.e. separately liftable from the helmet body, to allow strap adjustment.

Holder 25 is attached to a strap 27 that extends downwardly through a strap opening 28 in body 11, i.e. in body portion 11b'; and holder 26 is attached to a strap 29 that extends downwardly through a strap opening 30 in body 11, i.e. body portion 11b''. Each holder 25 and 26 operates to transmit strap tension to the helmet body; thus, the holders, being arc shaped, fit the arc shaped lateral upper surface 11f the helmet, as for example at the bottom of a lateral groove 32 sunk downwardly in the body portion 11b, whereby the upper surfaces of the holders 25 and 26 are substantially flush with the main outer or upper surface of the helmet. Groove 32 extends across the body 11, as shown.

Figure 4:
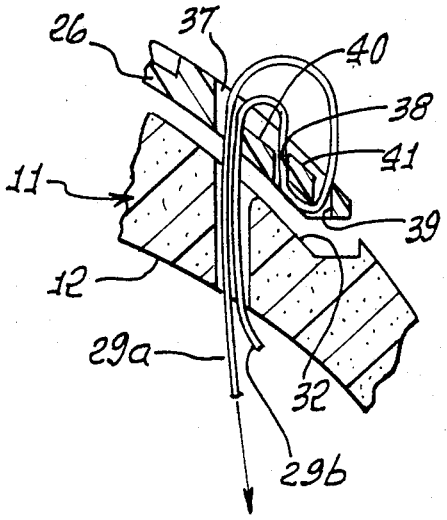
FIG. 4 is a fragmentary section of a portion of FIG. 3, showing a loosened strap.
Figure 5:
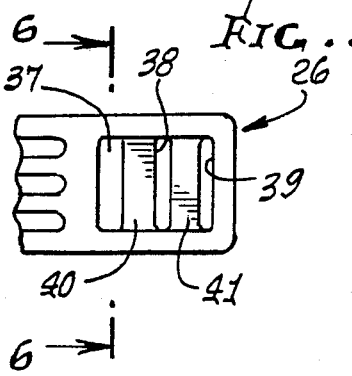
FIG. 5 is a partial plan view of a web lock.
Figure 6:
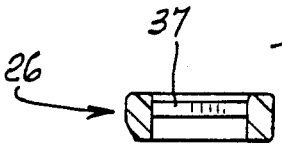
FIG. 6 is a section on lines 6—6 of FIG. 5.

It is a feature of the invention that the holder or holders 25 and 26 are liftable upwardly away from the helmet body i.e. out of the groove 32, to allow strap adjustment—i.e, lengthening or shortening. In this regard, each holder defines slot means, through which its associated strap passes, for adjustment retention. Accordingly, each strap is adjusted at a location at the top of the helmet, away from the face of the wearer, obviating need for any adjustment brackets or slots in plates next the wearer's face, which can irritate or disturb or distract the helmet wearer. As seen for example in FIGS. 3–5, band like holder, 26 defining through slots 37–39, and cross-pieces 40 and 41 extending crosswise of the slots, whereby strap lengths 29a and 29b extend upwardly through slot 37, then laterally over cross piece 40, and then loop downwardly about cross-piece 39. This allows relative sliding adjustment of the strap sections or lengths 29a and 29b to lengthen or shorten strap length 29a that extends downward uninterruptedly adjacent the wearer's face; and this sliding adjustment is typically carried out while the holder is elevated relative to the body 11. See FIG. 4.

Figure 3:
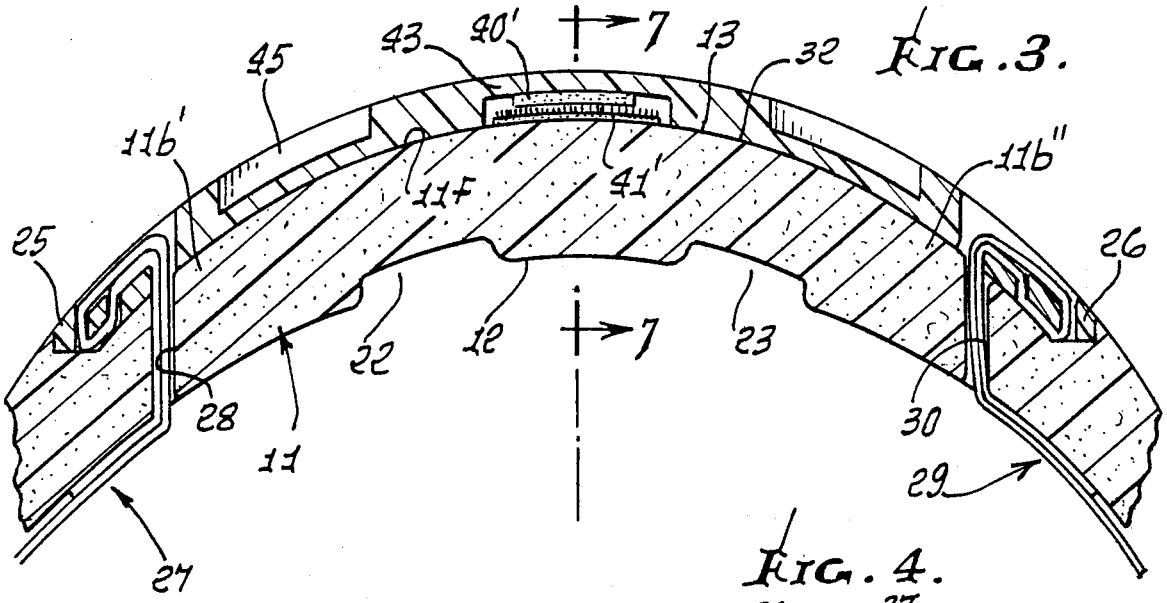
FIG. 3 is an enlarged section taken on lines 3—3 of FIG. 1.
Figure 7:
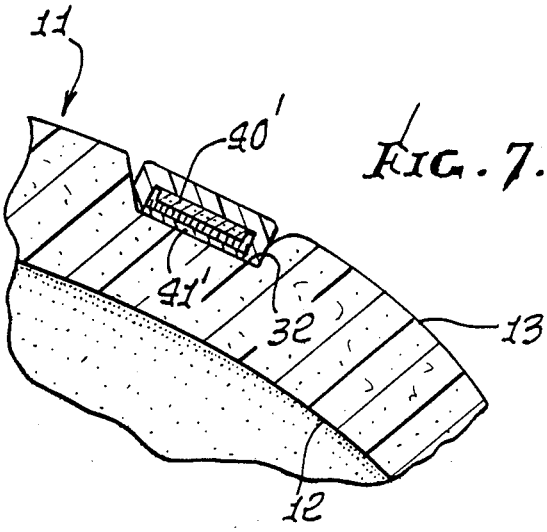
FIG. 7 is a vertical section taken on lines 7—7 of FIG. 3.

After completion of strap length adjustment, the arc-shaped holders 25 and 26 are lowered into position as seen in FIG. 3, in groove 32, and held therein. For example, a VELCRO (hook and pile) connection may be provided to releasably retain the holders 25 and 26 in down position. See VELCRO sections 40' and 41' in FIGS. 3 and 7 section 40' carried by the body 11 at the bottom of the groove 32, and section 41' carried by the underside of the holder mid portion 43. The latter is between holders 25 and 26 and integral therewith, for example, providing one unit band.

The holders 25 and 26 may be forcibly lifted upwardly by exerting upward prying force to free the two hook and pile sections. In this regard, FIG. 1 shows a notch 44 proximate a side of the re-entrant recess 32, for finger reception to lift the holder unit 25 and 26, and its upward arching mid portion 43, to allow strap adjustment above the helmet and body, as described. The holder unit may also contain lengthwise re-entrant slots 45, as shown.

Figure 10:
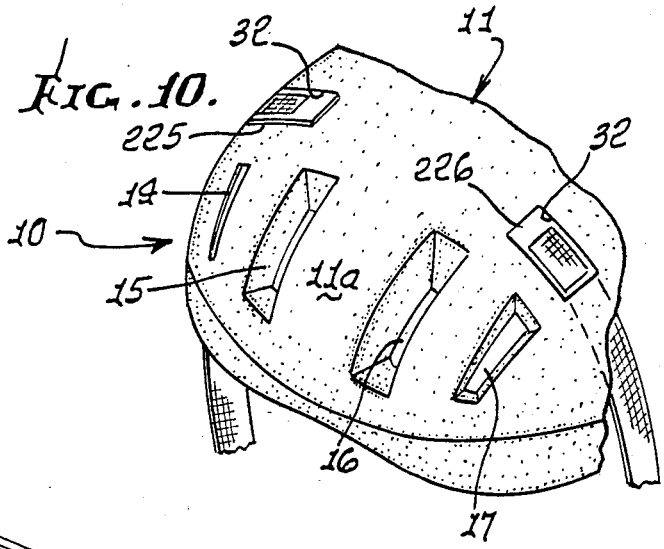
FIG. 10 is a modification depicting a fragmentary rear perspective view of a helmet having a two piece web lock.

FIG. 10 shows a modified helmet construction wherein the holders 225 and 226 are not connected by a midportion 43, but are separated, for downward reception in local recesses 32, at opposite sides of the helmet. Thus, each holder 225 and 226 in FIG. 10 is individually liftable from its recess 32, for strap adjustment, and locking when returned to recesses 32.

Figure 8:
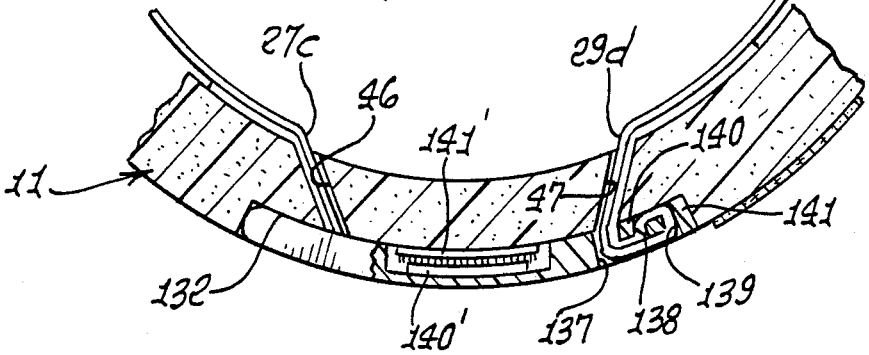
FIG. 8 is a horizontal section taken on lines 8—8 of FIG. 2.
Figure 9:
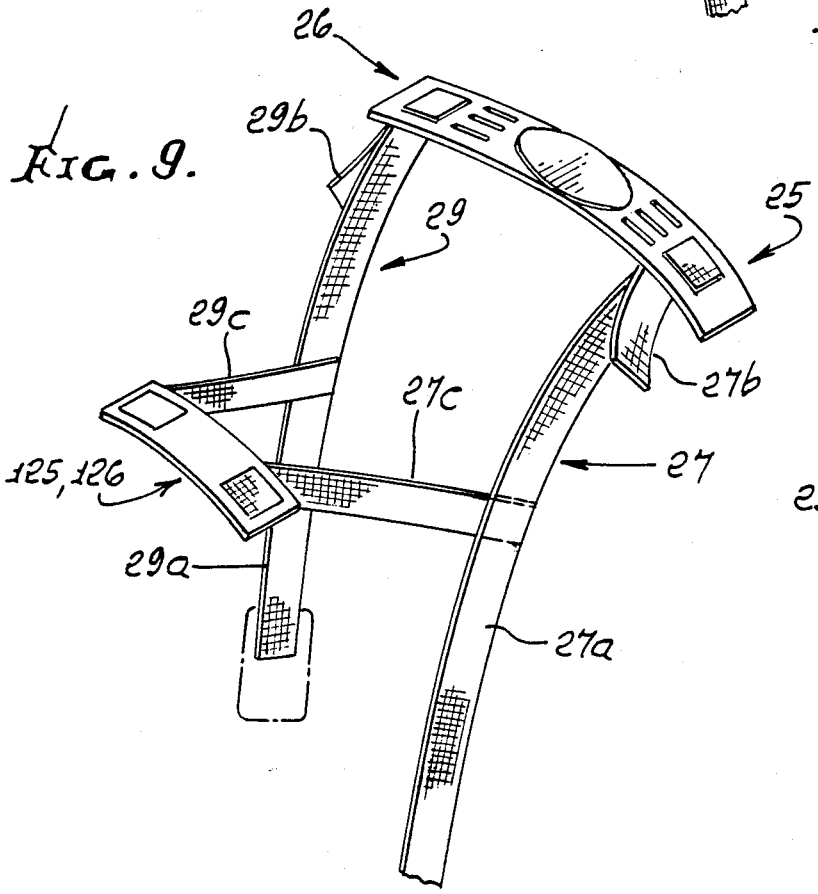
FIG. 9 is a perspective view of a strap harness of FIG. 1.

FIG. 9 shows a complete strap harness, with holders 25 and 26 as in FIG. 1. The harness also includes strap sections 29c and 29d, having their forward ends attached to sections holders 29 and 27 as shown. Rearward ends of the sections 29c and 27c pass through rearward openings 46 and 47 in the body 11 (see FIG. 8), and adjustably attach to holders 125 and 126 of an arc shaped rearward holder unit. The latter is received in a re-entrant rearward recess 132 in the body 11, and releasably retained therein as by VELCRO connection sections 140' and 141'. Thus, the holders 125 and 126 may be rearwardly separated from the body 11 to allow length adjustment of strap sections 29c and 27c. The latter have looping adjustable connection with holder cross-pieces 140 and 141, similar to cross-pieces 40 and 41. See associated slots 137–139, corresponding to slots 37–39. A tapered notch 44a is adapted to receive the wearer's finger to release (lift) the holder unit.

Figure 2:
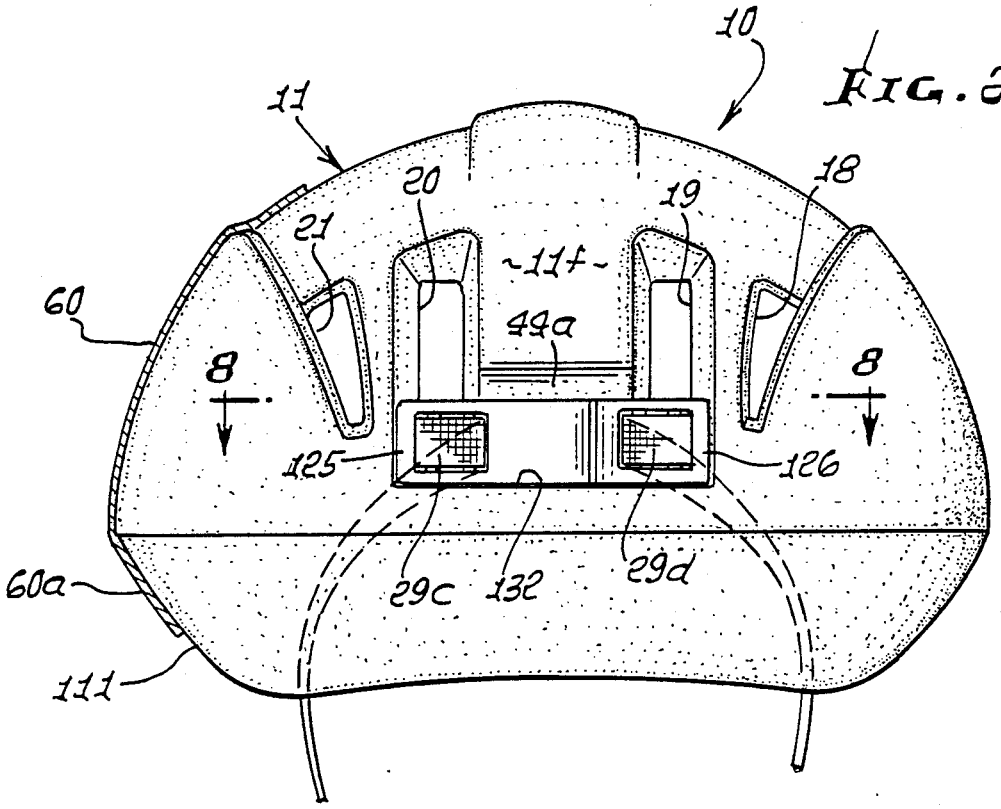
FIG. 2 is a rear elevation of the FIG. 1 helmet.

A net-like flexible and stretchable cover 60 may be fitted over the helmet to cover the holders and strap extents at the top of rear of the helmet, as seen in FIG. 2, the cover may have its lower edge portion 60a extending downwardly and inwardly along correspondingly slanted side wall extent 111 of the body 11, for retaining the cover in position.

Figure 9A:
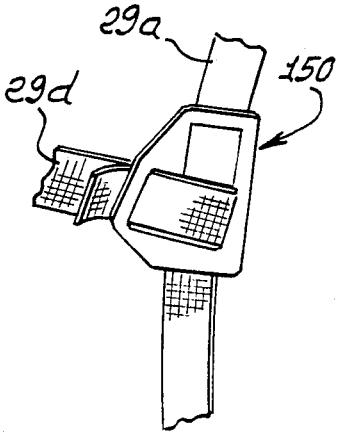
FIG. 9*a* shows an alternate harness connection.

FIG. 1 shows a buckle 149 to connect straps 27 and 29. In FIG. 9a, a clip 150, such as a plastic plate, is carried by the strap 29a, and the strap 29d attached to the clip, as shown.

Holders 125 and 126 may comprise a one-piece unit.

I claim:

1. In a helmet, the combination comprising (a) a generally domed shaped helmet body having inner and outer sides, (b) openings through the body to pass retention straps, (c) a first strap holder configured to be supported at and by the outer side of the helmet, the holder attached to at least one strap that extends through one of said openings, and the holder operable to transmit strap tension to the helmet, (d) attachment means positively attaching the holder to the helmet at said outer side thereof, (e) and wherein said attachment means comprises hook and pile elements, one of which is carried by the holder and the other of which is carried by the helmet body.

2. The combination of claim 1 wherein the holder defines slot means through which the strap passes for adjustable retention by the holder proximate said one opening.

3. The combination of claim 2 wherein said strap includes a first portion extending upwardly through the one opening for passing through the slot means, and a second portion extending back down into the one opening adjacent said first portion to terminate at or proximate said one opening.

4. The combination of claim 1 wherein said holder comprises solid material having band shape, the helmet having a re-entrant recess at said upper surface receiving said holder.

5. The combination of claim 4 wherein said band and said recess have arc shape, cross-wise of the helmet outer side.

6. The combination of claim 1 wherein said helmet body consists of air expanded synthetic resin.

7. The combination of claim 1 including a second strap holder configured to be supported at and by the outer side of the helmet, the second holder attached to a second strap that extends through another of said openings, and the second holder operable to transmit second strap tension to the helmet.

8. The combination of claim 7 including a net fabric cover fitting over the body and holders, and retained to the body proximate the lower edge thereof.

9. The combination of claim 7 wherein said two strap holders are interconnected.

10. The combination of claim 7 wherein the holders are located at the front and rear of the helmet body.

11. The combination of claim 1 including a fabric cover fitting over the body and holder and retained to the body proximate the lower edge thereof.

12. The combination of claim 9 wherein said two interconnected strap holders form an arch adapted to conform to curvature of the helmet body.

13. The combination of claim 1 wherein the holder is carried at a forward portion of the helmet, and including another holder configured to be supported by the outer side of the helmet at a rearward portion thereof, the other holder attached to a strap that extends through another of said openings.

14. In a helmet, the combination comprising (a) a generally domed shaped helmet body having inner and outer sides, (b) openings through the body to pass retention straps, (c) a first strap holder configured to be supported at and by the outer side of the helmet, the holder attached to at least one strap that extends through one of said openings, and the holder operable to transmit strap tension to the helmet, (d) said holder comprising solid material having band shape, the helmet having a re-entrant recess at said upper surface receiving said holder, (e) the helmet defining a notch proximate a side of the recess for finger reception to lift the holder from the recess, the holder being releasably retained in the recess.

15. The combination of claim 14 including attachment means positively attaching the holder to the helmet at said outer side.

16. The combination of claim 14 wherein the helmet body consists of an expanded polystyrene.

17. In a helmet, the combination comprising (a) a generally domed shaped helmet body having inner and outer sides, (b) openings through the body to pass retention straps, (c) a first strap holder configured to be supported at and by the outer side of the helmet, the holder attached to at least one strap that extends through one of said openings, and the holder operable to transmit strap tension to the helmet, (d) a second strap holder configured to be supported at and by the outer side of the helmet, the second holder attached to a second strap that extends through another of said openings, and the second holder operable to transmit second strap tension to the helmet, (e) and wherein the holders consist of solid material and have adjustable connections to said straps, the holders releasably attached to the helmet body to be lifted for effecting strap adjustment, and to be re-attached to the body.

18. In a helmet, the combination comprising (a) a generally domed shaped helmet body having inner and outer sides, (b) openings through the body to pass retention straps, (c) a first strap holder configured to be supported at and by the outer side of the helmet, the holder attached to at least one strap that extends through one of said openings, and the holder operable to transmit strap tension to the helmet, (d) a second strap holder configured to be supported at and by the outer side of the helmet, the second holder attached to a second strap that extends through another of said openings, and the second holder operable to transmit second strap tension to the helmet, (e) said two strap holders being interconnected, and forming an arch adapted to conform to curvature of the helmet body, (f) the two holders forming slots and crosspieces for strap reception and connection, there being attachment means on a region of the arch between the slots defined by the two holders, for attachment to the helmet at an outer side thereof, the attachment means allowing lifting of the arch for adjustment of the straps relative to the holders.

19. The combination of claim 18 wherein said two holders are carried at a forward portion of the helmet, and including another holder configured to be supported by the outer side of the helmet at a rearward portion thereof, the other holder attached to a strap that extends through another of said openings.

20. The combination of claim 19 wherein the straps have interconnection to form a harness.

21. The combination of claim 19 wherein said other strap includes two strap sections extending through spaced openings in the helmet body, said strap sections adjustably attached to said other holder at spaced portions thereof, located at the upper side of the helmet body.

* * * * *